US006289657B1

(12) United States Patent
Stevens

(10) Patent No.: US 6,289,657 B1
(45) Date of Patent: Sep. 18, 2001

(54) MAIL INSERTER MACHINE

(76) Inventor: Kenneth A. Stevens, 1099 Atlantic Dr., Unit 2, West Chicago, IL (US) 60185

( * ) Notice: Subject to any disclaimer, the term of this patent is extended or adjusted under 35 U.S.C. 154(b) by 0 days.

(21) Appl. No.: 09/337,286

(22) Filed: Jun. 21, 1999

Related U.S. Application Data

(63) Continuation of application No. 08/760,387, filed on Dec. 4, 1996, now abandoned, which is a continuation-in-part of application No. 08/446,403, filed on May 22, 1995, now abandoned.

(51) Int. Cl.[7] ..... B65B 43/26
(52) U.S. Cl. ..... 53/569; 53/284.3
(58) Field of Search ..... 53/569, 284.3, 53/381.7, 507, 508; 74/567, 568 R

(56) References Cited

U.S. PATENT DOCUMENTS

| | | | | |
|---|---|---|---|---|
| 1,803,049 | * | 4/1931 | Bouton | 53/569 |
| 2,865,155 | * | 12/1958 | Nydegger | 53/569 |
| 3,927,507 | * | 12/1975 | Reid | 53/553 |
| 4,067,172 | * | 1/1978 | Paules | 53/540 |
| 4,337,609 | * | 7/1982 | Foster et al. | 53/284.3 |
| 4,510,732 | * | 4/1985 | Lothman | 53/168 |
| 4,739,606 | * | 4/1988 | Cantile | 53/569 |
| 4,741,147 | * | 5/1988 | Noll | 53/284.3 |
| 5,048,366 | * | 9/1991 | Spanio | 74/568 R |
| 5,085,099 | * | 2/1992 | Hughes | 74/568 R |
| 5,150,562 | * | 9/1992 | Araki et al. | 53/530 |
| 5,155,968 | * | 10/1992 | Mosse et al. | 53/64 |
| 5,220,770 | * | 6/1993 | Szewczyk et al. | 53/284.3 |
| 5,253,546 | * | 10/1993 | Elrod et al. | 74/568 R |
| 5,361,736 | * | 11/1994 | Phoenix et al. | 74/568 R |
| 5,517,797 | * | 5/1996 | Ballard et al. | 53/569 |

* cited by examiner

*Primary Examiner*—Peter Vo
*Assistant Examiner*—John Paradiso
(74) *Attorney, Agent, or Firm*—Lee, Mann, Smith, McWilliams, Sweeney & Ohlson

(57) ABSTRACT

A mail inserter machine having a drive system including a drive motor, gear reducer unit and indexing unit. The drive motor and gear reducer communicate by a belt driven around pulleys residing in a plane and the gear reducer communicating through a direct shaft drive with the indexing unit. The indexing unit rotating a belt pulley which carries a belt connected to a timing pulley for driving a cross shaft. The belt pulley and timing pulley residing in a plane parallel to said drive motor and gear reducer unit pulleys. Said drive system arranged in a lower portion of the mail inserter machine chassis, whereby the said parallel planar pulleys thereby generate forces vectored in parallel directions enabling a greater size, greater precision, high durability, and greater dynamic stability for the mail inserter machine.

7 Claims, 11 Drawing Sheets

MAIL INSERTER MACHINE

RELATED APPLICATION

This application is a continuation of Ser. No. 08/760,387, filed Dec. 4, 1996, now abandoned, which is a continuation-in-part of patent application Ser. No. 08/446,403 filed May 22, 1995 now abandoned, which is incorporated herein.

TECHNICAL FIELD

This invention relates to a mail inserter machine, more particularly to an improved mail inserter machine that inserts documents into mailing envelopes and seals the envelopes, and that operates more efficiently and requires significantly less time to repair and replace parts.

BACKGROUND OF THE INVENTION

Presently, there exist a number of machines that perform the function of inserting envelopes, manipulating garbage bags for packaging, and generally for transferring items on a machine from one location on the machine to other locations on the machine.

Many of the envelope inserting machines have the capacity for performing the functions of separating inserts from a stack, opening the envelopes, inserting mailing inserts inside the envelopes, putting pre-determined printed matter on the envelopes, and sealing the envelopes. Having a machine that can perform all these functions can be very beneficial to the user, especially for the user having a large capacity of mailings to be mailed.

However, one major disadvantage of using this type of machine is the time and expense used to repair and service the machines. Specific functioning components on the mail inserter machine which require substantial time and cost to repair and service include the front table cam shaft, the upper drive shaft, and the main drive system.

The front table cam shaft is a continuous rotating shaft fitted with individually adjustable cams. Each cam on the shaft controls a separate function in the machine. For example, the cams may operate a stacker for stacking envelopes, a flap closer for closing the flaps of envelopes, a sucker bar for moving suction cups which adhere to the envelopes, and jaw openers used to grip the envelopes. Of course additional cams can exist on the front table cam shaft for performing additional functions. During the manufacturing of a front table, the installation of the cam shaft requires that bearing assemblies be bolted onto the table, and then a line reamer is run through the bearing blocks. Each bearing block has an individual bushing pressed therein. The reamer opens the bushings inside diameter to the equivalent size of the outside diameter of the cam shaft. The bushings are approximately in line with each other prior to reaming. Line reaming will match and line up the bushings inside diameter exactly. Once the bearing blocks are line reamed they can not be replaced individually without extensive time and effort. One bushing may be reamed slightly higher or lower than another bushing, while another may be further forward on the table than other bushings. If one bearing block bushing wears out because of extensive machine use or lack of lubrication before others, the individual block bearing bushing may not have to be replaced but can be line reamed. Line reamers are usually not available in the field therefore a hand reamer would be used. Shimming the bearing block would be required. Occasionally, bushing is reamed oversized deliberately to cut down on a lengthy repair process. This is not good practice and will result in repeat bushing failure. Once the bearing blocks are line reamed assembly of the front table can begin. Installation of the cam shaft along with mounting and all the cams, collars, sprockets, and gears onto the shaft is first, everything else is attached on top or along side of the cam shaft. Replacing a cam shaft can be strenuous and time consuming. To replace a cam shaft, the shaft has to be rotated to loosen all the set screws attached within the cams and components mounted on the shaft. The cams and components are moved sideways along the shaft to allow set screw burr marks to be removed by filing to enable components to be removed from the shaft. Sometimes the cam shaft is bent to the extent that the shaft can not be rotated. The shaft is driven by a sprocket keyed to the shaft. Keys are usually drilled, pinned and fitted to the cam shaft for rotating the cam shaft. If the cam shaft bends it usually bends where the sliding sprocket is, and the key is usually bent as well. Sometimes a damaged cam shaft has to be cut in half to be removed. Clearance for using a hack saw or the like to cut the shaft and gain access to the non-turning cam shaft and set screws requires extensive time to remove the front table top plate and many other attached parts. Removal of the bearing block mounting bolts, sprocket guide and drive chains must also be completed before removing the cam shaft. This removal process takes a number of hours. Users of the mail inserter machine usually cannot afford lengthy repairs and down-time necessary for repairing or replacing an individual bushing mounted on the front table around the shaft.

Another problem area on inserter machine requiring substantial time and cost to service and repair is a rotatable upper drive shaft. This shaft has a round diameter and has mounted therearound a number or bearings and bearing blocks supporting and aligning the shaft. The shaft also has a keyway slot therein for a sliding bevel gear assembly. Present manufacturing of the sliding bevel gear include a key which is fastened to the inside key way of the bevel gear. In operation, as the shaft rotates, the shaft aligns itself within the supporting bearing blocks. In aligning within the bearing blocks, the shaft places concentrated loads on the bearing blocks supporting it. This aligning causes the concentrated loadings on the bearing blocks to eventually wear on the supporting bearings inside the bearing blocks, thereby creating a need to replace the worn bearings. To replace the worn bearings, the bearing block or blocks containing the worn bearings must be removed from the table it is mounted upon. Since the shaft is one continuous elongated member, when removing one bearing block to replace the bearing inside, the bearing block must be detached from the supporting table and slid off the end of the shaft to allow the bearing block. On the lower cam shaft, several blocks may have to be removed to get to the worn block. Conversely, when replacing the new or repaired bearing blocks back onto the table and shaft, the other bearing blocks must also be positioned back on the shaft and mounted back onto the supporting table. When remounting the bearing blocks, extensive time must be taken to align the bearing blocks with the shaft for effective and efficient rotation of the cam shaft.

A third component of the mail inserter machine requiring substantial time and cost to service and repair is the main belt drive system which drives the mechanisms of the machine. In present envelope inserter machines, the main drive systems transfer the driving force from a drive motor to a prior art speed reducer via a drive belt. Output drive from the prior art speed reducer is used to transfer rotational force to both a cam indexing box and to a cam shaft via drive chains. During operation, the prior art drive chains stretch, sprockets wear, and eventually require replacement. As the chains stretch, tension and timing functions may require occasional readjustment to compensate for the stretching (or chain/sprocket wear). The prior art cam indexing box drives the indexing portion of the inserter via a ring and pinion gear 3-to-1 drive configuration. The ring and pinion gear are aligned, and corresponding bearing posts are pinned to avoid change in alignment. This alignment process is service intensive and time consuming

SUMMARY OF THE INVENTION

The present invention contemplates to eliminate the aforementioned disadvantages of the front table cam shaft, the upper drive shaft, and the main drive system.

To avoid lengthy repairs and down time caused by having to replace worn bearings on a front table cam shaft, an improved front table cam shaft is provided. The improved front table camshaft is a continuously rotating shaft, with individually adjustable cams mounted on it. The cams control operating functions of the front table, such as opening envelope flaps, opening envelopes for insertion, detecting the envelopes and envelope flap closing. Other cams may also be used to operate additional functions. The shaft has either three (3) or two (2) separate sections depending on its length. Starting from one end of the shaft (the three (3) section shaft), a first shaft section having a round cross-section extends through two (2) ball bearing split cap bearing blocks into a flexible zero backlash coupling. An improved ball bearing split cap bearing block design allows each of the shaft sections to be removed without having to slide a shaft section completely through any individual bearing block. The top portion the bearing block can be unclamped, allowing a shaft section to be simply lifted upward and removed from the assembly. Coupled to a second shaft section having a round cross-section, the shaft extends through two more ball bearings secured in split cap bearing blocks. A two (2) section shaft uses a solid first and second section. The third section of the camshaft has round ends with a hexagonal main body. The round ends extend through the is ball bearings. The hexagonal portion of the shaft is provided for a mounted sliding sprocket which has a corresponding machined hexagonal or square bore. The purpose of the machined hexagonal or square shape is to allow for lateral travel of the front table, while maintaining sprocket alignment with the drive sprocket in the main machine frame without the use of a key. The sliding sprocket has a groove therein into which a guide is positioned. The guide is also attached to the machine frame. As the front table moves laterally, the sprocket, which is held in drive alignment by the guide, does not travel laterally. The hex shaft which moves through the sprocket does travel laterally with the table. The sprocket is not fastened to the hex shaft. The shaft is free to slide through the sprocket. The improved front table cam shaft includes bearing blocks fitted with roller bearings. The sectional section shaft design allows for easy removal of a section needing repair by just sliding the coupling back and removing the section. The front table top plate does not have to be removed to access the cam shaft. If the cam shaft is bent at the sliding sprocket, that particular section can be removed without having to remove the entire sectional shaft. The sliding sprocket portion of the roller bearing style front table is a heavy machined hexagonal or square shaft with no key required to be rotated by the sprocket on the shaft. The machined shaft portion acts as a key and is turned down at both ends to fit into the roller bearings coupling and bevel gear. The roller bearing block has matching mounting hole locations and cam shaft centers as the standard bearing blocks with bushings. The advantage of using the same mounting hole location and cam shaft center is that cam shaft replacement service time is reduced by using the roller bearing design with sectional shafts. The cam shaft outside diameter remains the same as the standard one piece shaft; however, the outside diameter is not a critical issue. Time to bolt down the bushing blocks, ream, fit and install various cam and related parts is greatly reduced through use of a sectional shaft, since an entire one-piece shaft with all its accompanying attachments\cams do not have to be removed. The improved sectional shaft allows for removal of only one section of the sectional shaft to replace or repair any bearing block, cam, or other component mounted on that particular section of the shaft. Additional benefits of the use of roller bearing in the improved front table cam shaft include less of a need to lubricate the bearing, unlike the standard bushing design, thereby requiring less torque to operate the machine. Reduced load translates into reduced power (electrical) and reduced cost to operate the mail inserter machine.

An improved upper drive shaft is also provided. The improved upper drive shaft uses roller bearings for a smoother drive and easier assembly. The shaft exists as an anti-fatigue machined hexagonal or square steel shaft. A bevel gear is attached to a machined hexagonal or square bore tube. A major advantage of the improved upper drive shaft is its machined cross-section. The gear assembly is driven by sliding the machined tube over the machined upper drive shaft thereby providing for full contact between the machined tube and the matching machined upper drive shaft. The present round shafts have gear assemblies driven by a key in a keyway which provide for less than 10% shaft drive contact. The improved drive shaft provides for fitted full contact drive shaft.

Also provided in the improved mail inserter is an improved main drive system. The improved main drive system has simplified the present method that transfers force from a drive motor to a speed reducer via a drive belt by transferring the drive force from the drive motor to a one unit reducer cam (indexing) box via a belt. The cam shaft output drive, the indexing drive is taken directly to the drive shafts without the use of an additional 3-to-1 ring and pinion gear drive via timing belts. The direct drive approach, via timing belts, eliminates lining up and fitting the ring and pinion gear. The ring and pinion gears require a perfect mesh to avoid destroying the gear set. Alignment can be service intensive and time consuming. This direct drive approach reduces the number of parts required to operate the main drive system. Reduction of parts translates into less parts to service, maintain and replace. The improved main drive system also provides a smoother drive.

DETAILED DESCRIPTION OF THE PREFERRED EMBODIMENT

Figure 1:
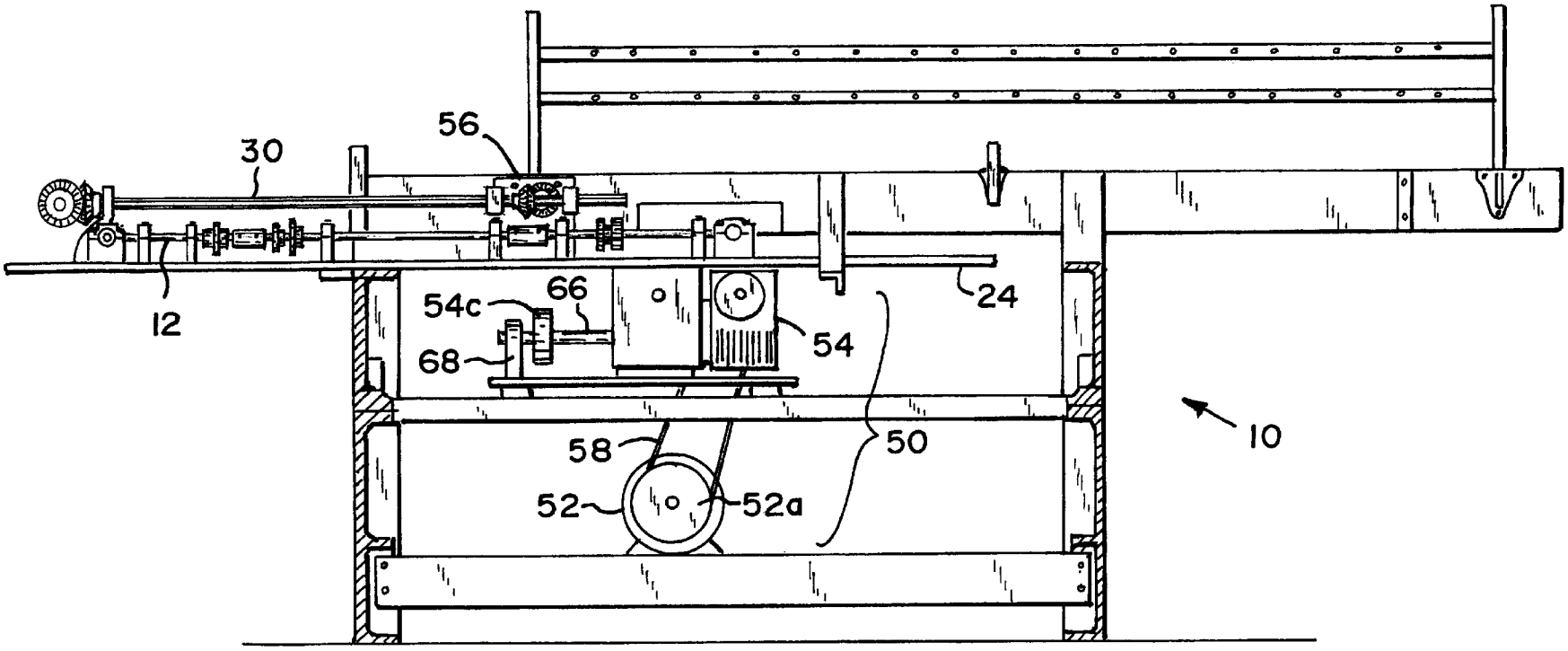
FIG. 1 is a front plan view on the mail insetter machine the front table cam shaft, the upper drive shaft, and the main drive system.

The principles of the invention are particularly useful when embodied in a mail inserter machine as shown in FIG. 1, generally indicated by the numeral 10. In a preferred embodiment as better seen in FIG. 1, the improved mail inserter machine includes a front table cam shaft 12, an upper drive shaft 30, and a main drive system 50.

Figure 2:
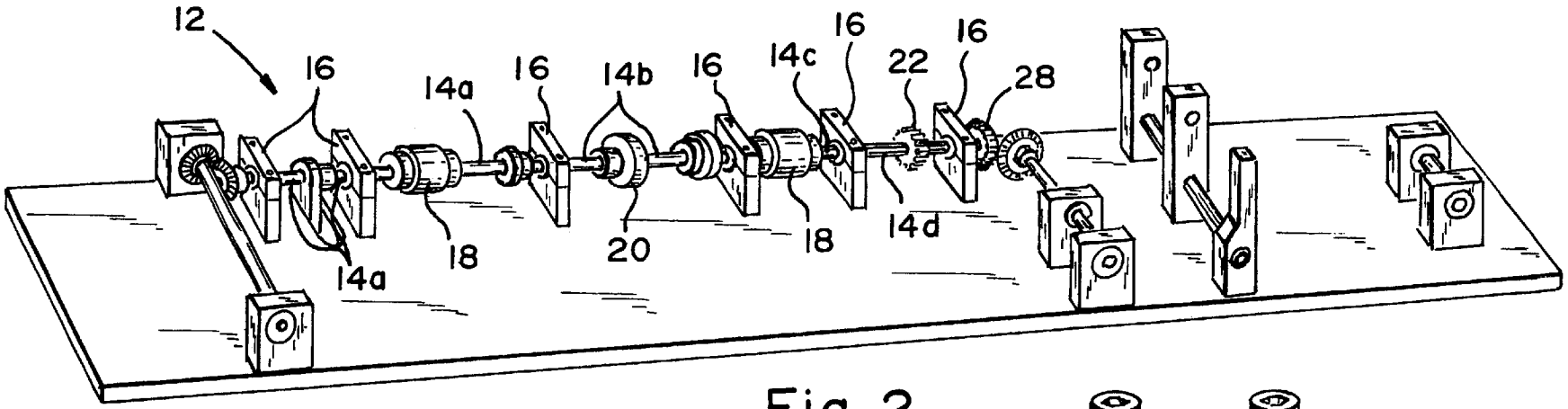
FIG. 2 is a perspective view of the front table cam shaft with attached components.
Figure 3:
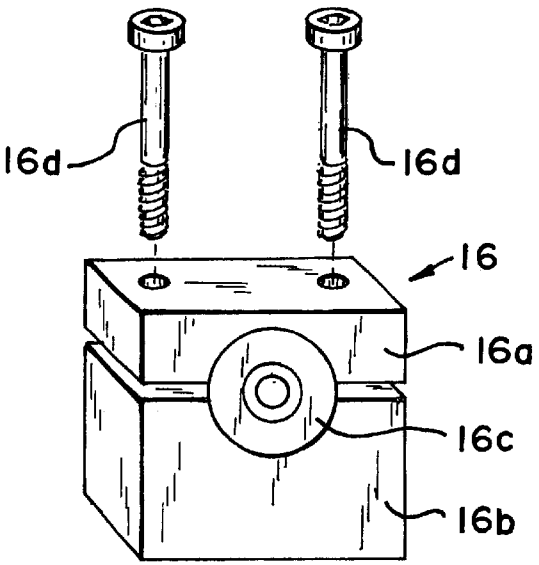
FIG. 3 is a perspective view of a ball bearing split cap bearing block.
Figure 4:
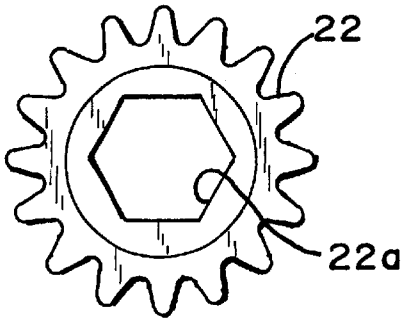
FIG. 4 is a front plan view a sprocket having a hexagonal bore.
Figure 5:
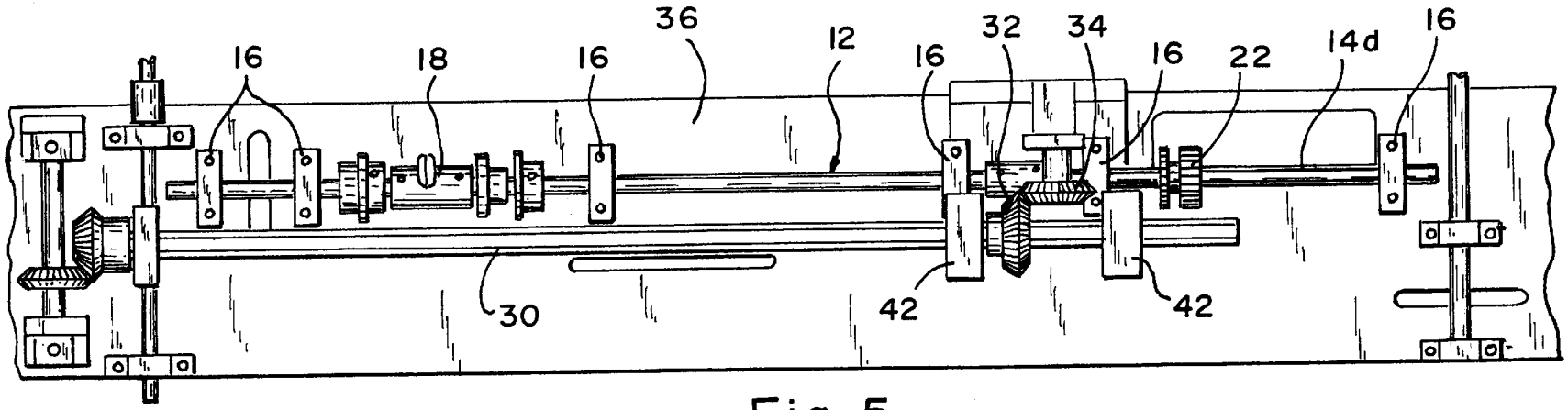
FIG. 5 is a top plan view of the front table cam shaft and upper drive shaft.
Figure 6:
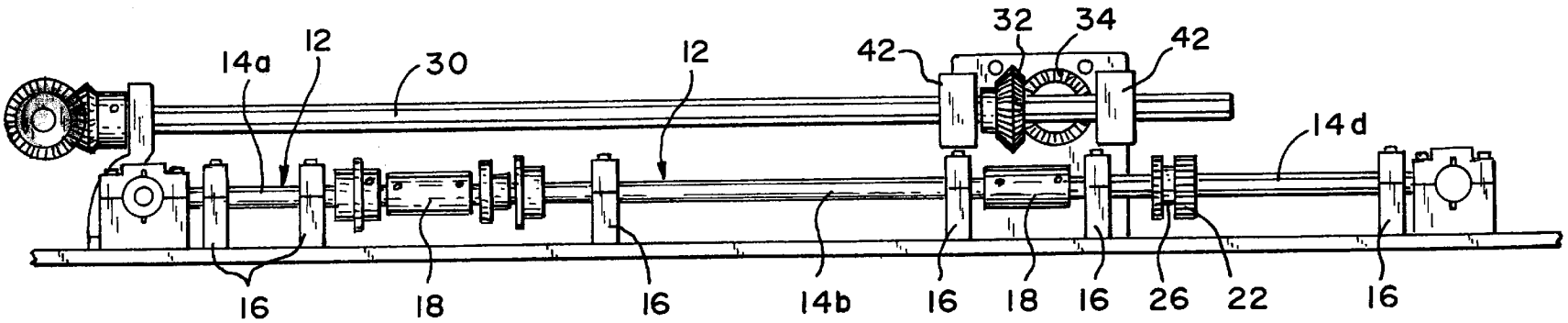
FIG. 6 is a side plan view of the front table cam shaft and upper drive shaft.
Figure 9:
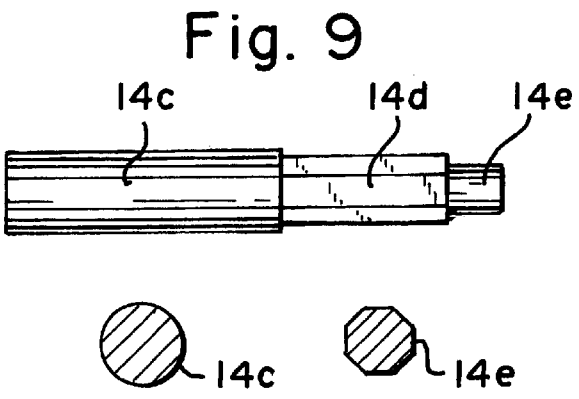
FIG. 9 is a plan side view of a third cam shaft section.
Figure 8:
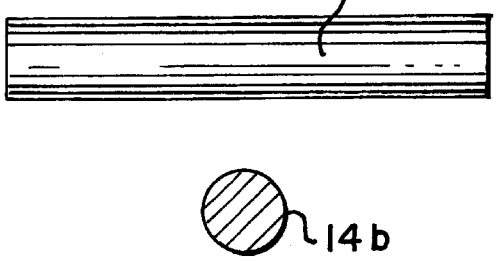
FIG. 8 is a plan side view of a second cam shaft section.
Figure 7:
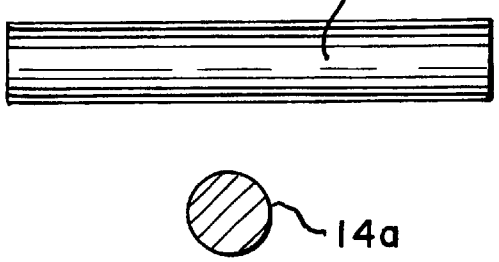
FIG. 7 is a plan side view of a first cam shaft section.
Figure 10:
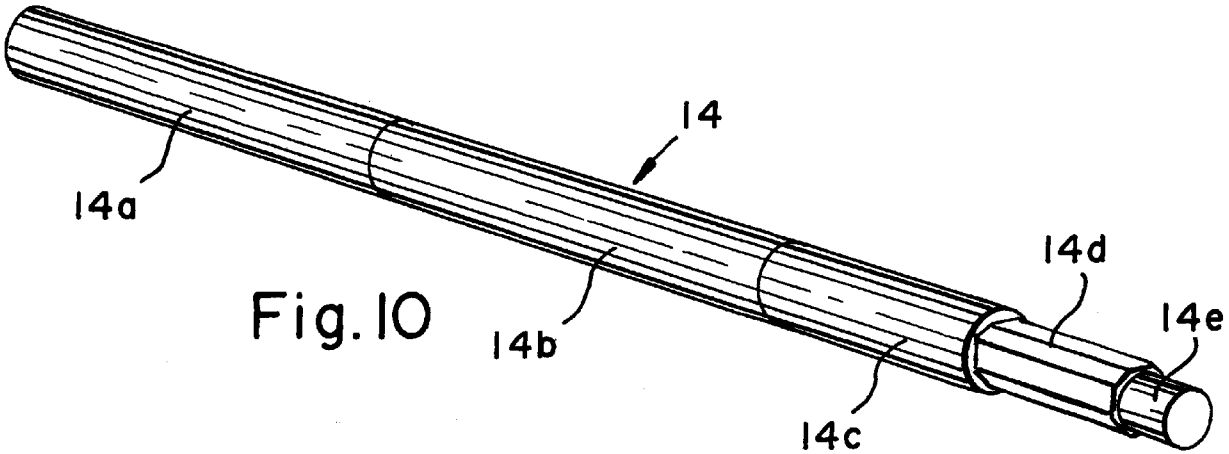
FIG. 10 is a perspective view of all three sections of the front table cam shaft.
Figure 11:
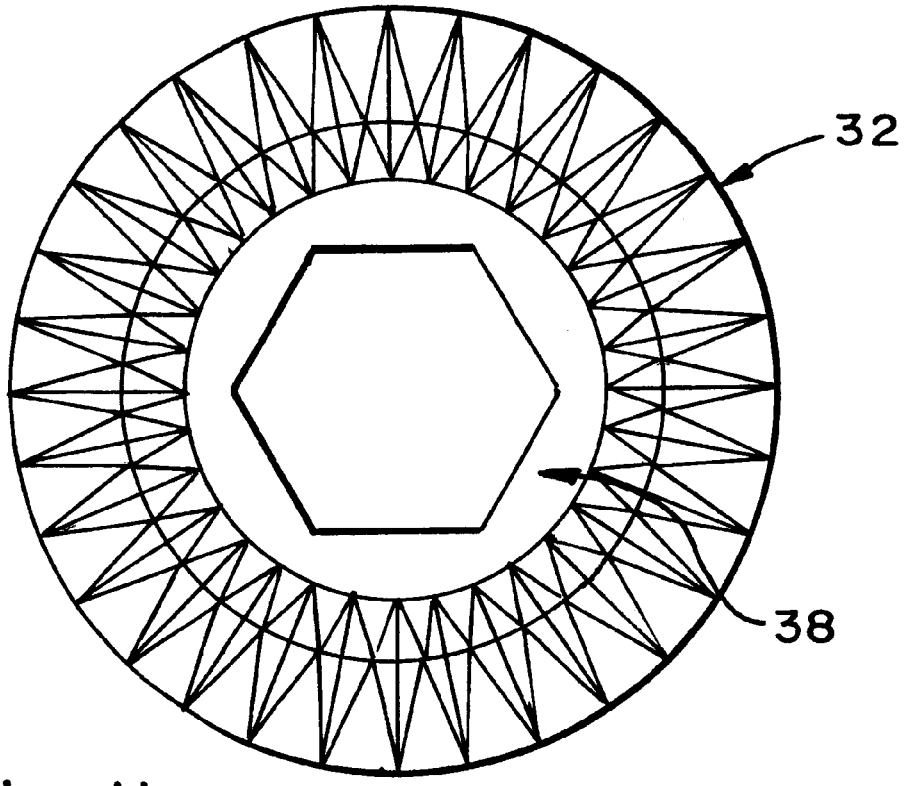
FIG. 11 in a plan front view of a machined hex tube with a bevel gear attached thereto.
Figure 12:
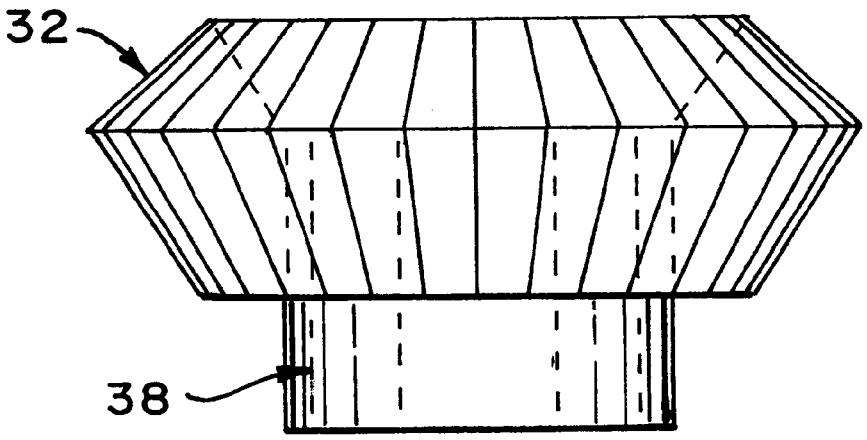
FIG. 12 is a side view of the machined hex tube with a bevel gear attached thereto.
Figure 16:
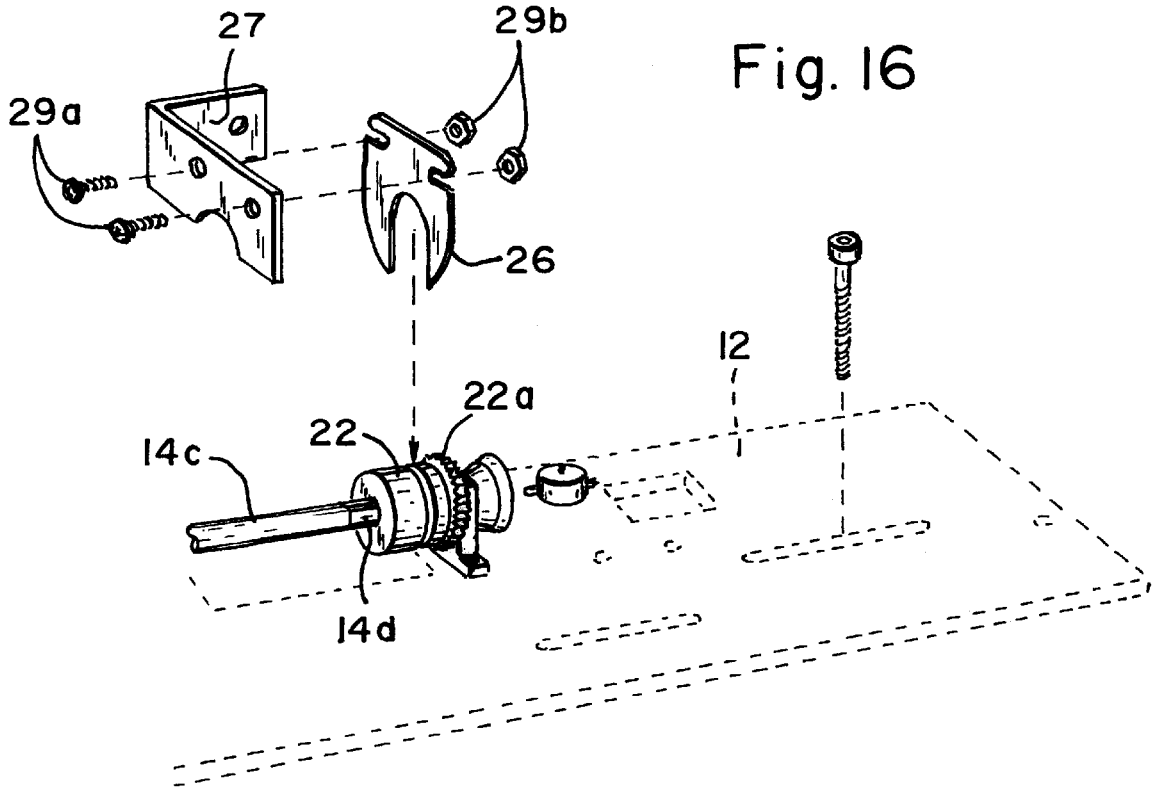
FIG. 16 is perspective view of a section of the improved front table cam shaft showing a section of the shaft, a sprocket, a sprocket guide and a guide bracket.

The front table cam shaft 12 consists primarily of a cam shaft 14 having three (3) shaft sections 14*a*, 14*b*, and 14*c* as seen in FIGS. 2, 7–10. First cam shaft section 14*a* has a uniform round cross-section throughout its length. Second cam shaft section 14*b* also has a uniform round cross-section throughout its length. Third cam shaft section 14*c* consists of a round extending section 14*c*, an integral hexagonal section 14*d* and a round end section 14*e*. As seen in FIG. 2, 5, and 6 the first cam shaft section 14*a* extends through two (2) ball bearing split cap bearing blocks 16 into a flexible zero backlash coupling 18. As seen in FIG. 3, the one piece split cap bearing block 16 is comprised of a bearing block top clamping portion 16*a*, and bearing block bottom portion 16*b*, and ball bearings 16*c* positioned between the top and bottom bearing block portions 16*a*, 16*b*. Fasteners 16*d* extend through top portions 16*a* and 16*b* into a front table plate 24 to attach the bearing block 16*a* and bearing and the cam shaft 14 to the front table plate 24. The fastener 16*d* on the solid side of the block locates to block position. The fastener on the split side clamps the bearing into position. The first cam shaft section 14*a* extends to the second cam shaft section 14*b* where it is coupled to the second cam shaft section 14*b* with a coupling 18. The second cam shaft section 14*b* extends through another two (2) ball bearing sets 16*c* secured in split cap bearing blocks 16. The second cam shaft section further extends to a third cam shaft section 14*c*. The second cam shaft section 14*b* is coupled to the third cam shaft section 14*c* with a coupling 18. The third cam section 14*c* extends into an integral machined section 14*d* and then into an integral round end section 14*e*. The integral round end section 14*e* extends into a set of ball bearings 16*c* maintained in a ball bearing split cap bearing block 16. As seen is FIGS. 2, 4 and 16, a sprocket bore 22*a* having a sprocket 22 mounted thereon is mounted on the integral camshaft machined hexagonal section 14*d* (FIG. 9). The sliding sprocket 22 has a groove 22*a* therein (FIG. 16). A guide 26 is positioned within the groove 22*a* of the sprocket 22. The guide 26 is also mounted to the main frame of the mail inserter 10 via guide bracket 27. The third cam shaft 14*c* is free to move through the sprocket 22 which is fixed to the main frame of the inserter via a guide bracket 27 by guide 26 (FIG. 16). As the front table 12 moves laterally, the sprocket 22, which is held in drive alignment by the guide 26, does not travel laterally. More specifically, the front table 12 and all parts mounted to the table 12 move laterally. The sprocket 22, which is not mounted to the table 12, but is mounted directed to the fixed main frame via guide bracket 27 does not move. As better seen in FIG. 16, an L-shaped guide bracket 27 is attached to the machine frame. Guide 26 is attached to guide bracket 27 by screws 29*a* and nuts 29*b*. A cam shaft bevel gear 28 is attached to the end of the cam shaft round end section 14*e* (FIGS. 2, 9 and 10).

Mounted above the front table cam shaft 12 is an upper drive shaft 30 (FIG. 1, 5 and 6). The upper drive shaft 30 has a uniform machined hexagonal cross-section. A sliding bevel gear 32 having a machined hex tube 38 with a hexagonal bore therein is mounted on the upper drive shaft 30 (FIG. 5, 6, 11 and 12). The upper drive shaft 30 extends through two (2) bearing blocks 42 having hexagonal bores bearings mounted therearound. As bevel gear 34 turns, it transmits rotational forces to corresponding sliding bevel gear 32, thereby, turning the hex tube 38 which in mounted inside the bore of the sliding bevel gear 32. The inner bore surface of the machined hex tube 38 is in close tolerance contact with the machined hexagonal shaft 30. Turning of the hex tube 38 mounted on the hexagonal shaft 30, thereby, causes the hexagonal shaft 30 to rotate with a corresponding rotational motion.

Figure 13:
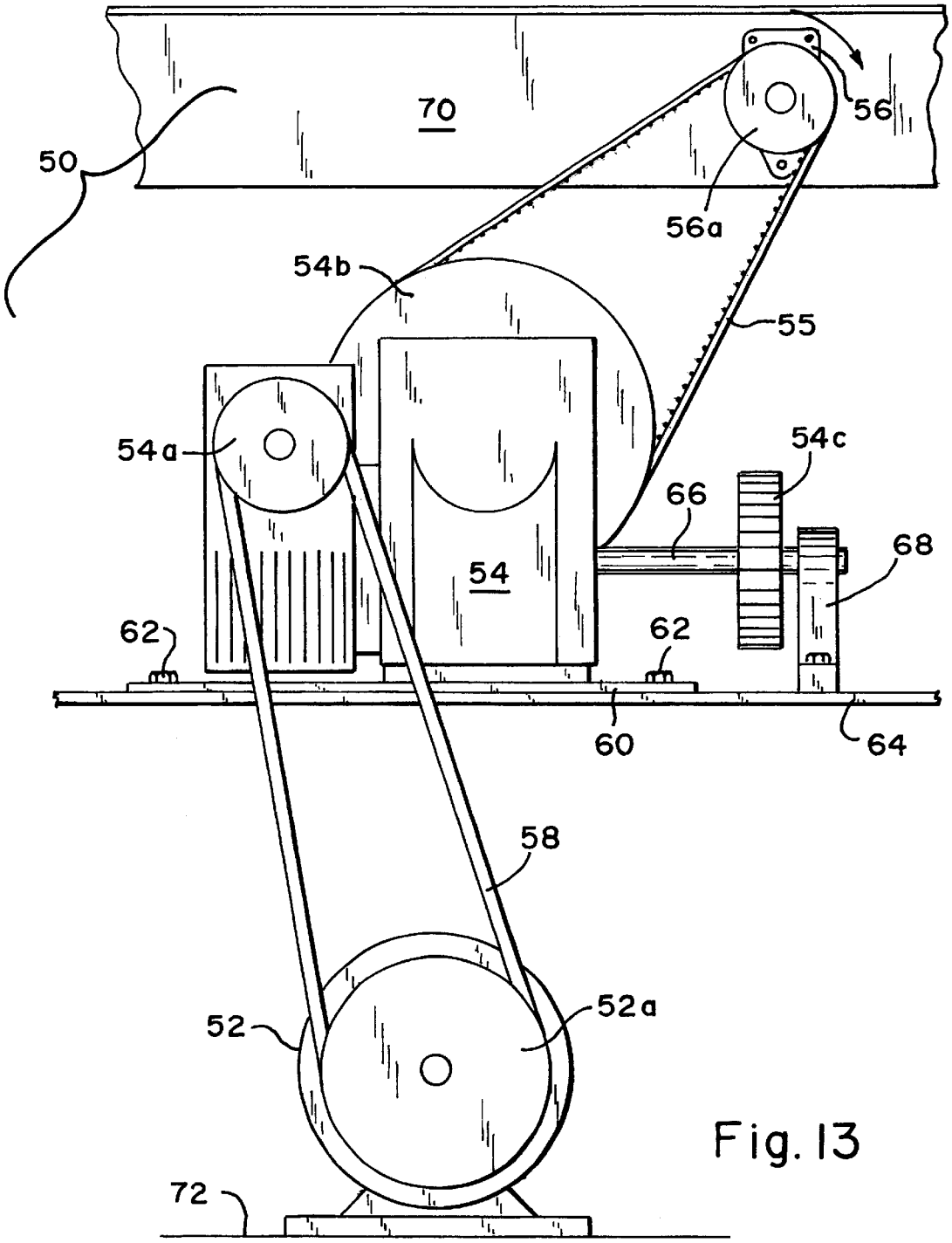
FIG. 13 is a front plan view of the first embodiment of the main drive system.
Figure 14:
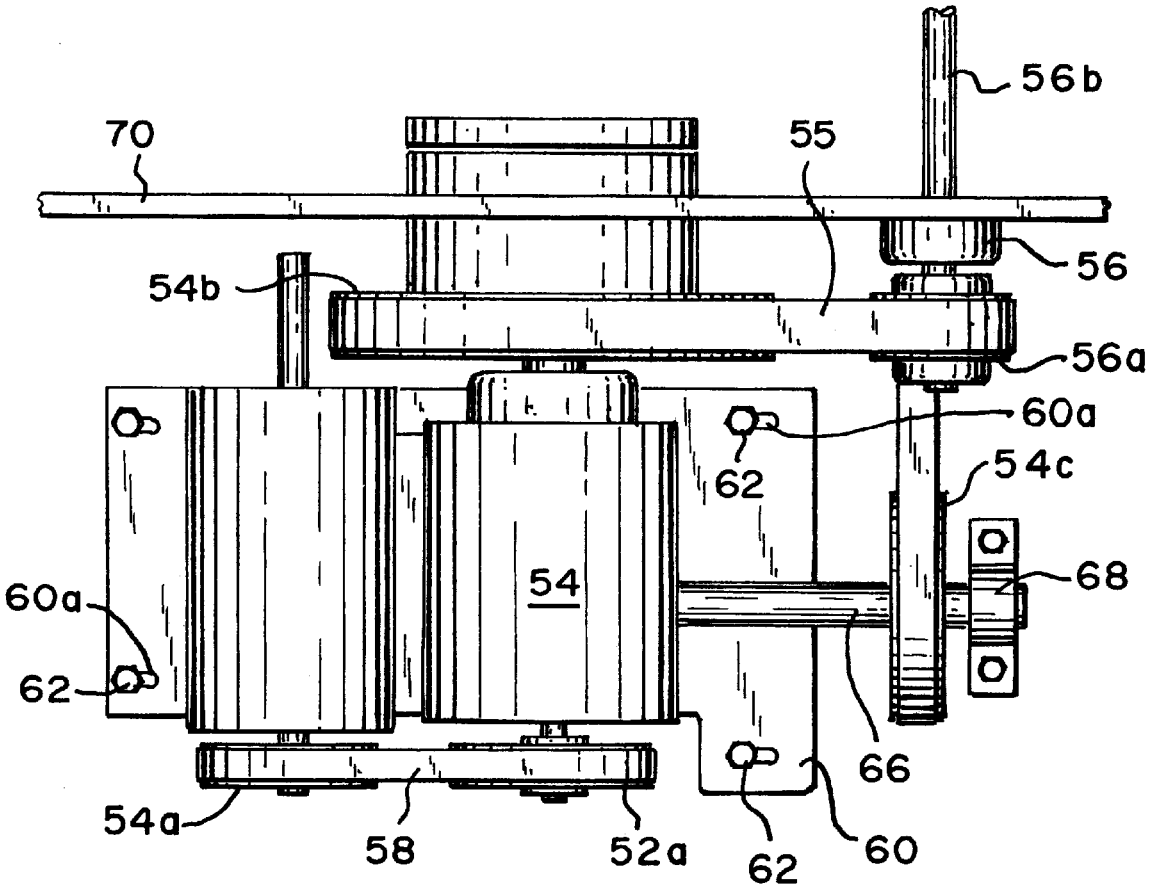
FIG. 14 is a top plan view of the first embodiment of the main drive system.

The improved mail inserter machine also has provided an improved main belt drive system 50 to the machine's 10 various functions. In a first embodiment as seen in FIGS. 1, 13 and 14, the drive system 50 consists primarily of an electrically powered drive motor 52 mounted on a lower mounting plate 60 having a motor pulley 52*a*, a drive unit 54 having a receiving drive pulley 54*a*, an indexing clutched timing belt pulley 54*b*, and a continuous drive pulley 54*c*. The main drive system 50 also includes a cam shaft drive 56*b*. A drive motor "V" belt 55 is in rotational connection with the indexing clutched timing belt pulley 54*b* and the indexed timing pulley 56*a*. As will be appreciated by one of ordinary skill upon review of FIG. 13, pulley 54*a* and pulley 54*c* rotate in planes perpendicular to one another.

The drive motor 52 is mounted to a lower frame base 72 accessible from the lower rear side in the mail inserter machine 10. In the preferred embodiment the drive motor is DC powered. The drive unit 54 is mounted to a mounting plate 60. The mounting plate 60 is mounted to an elevated shelf 64 accessible from the rear of the mail inserter machine 10. The mounting plate 60 has a plurality of slots 60*a* therein for bolting fasteners 62 therethrough to securely mount plate 60 to shelf 64. A drive shaft 66 extends axially from drive unit 54 to bushing block 68 which is rotatably mounted to shelf 64. The cam indexing box 56 is mounted to an upper machine side rail 70 which extends horizontally across inside the rear of the mail inserter machine 10. In operation, the drive motor 52 powers the machine 10 by transferring power to the drive unit 54 via drive belt 58.

Figure 15:
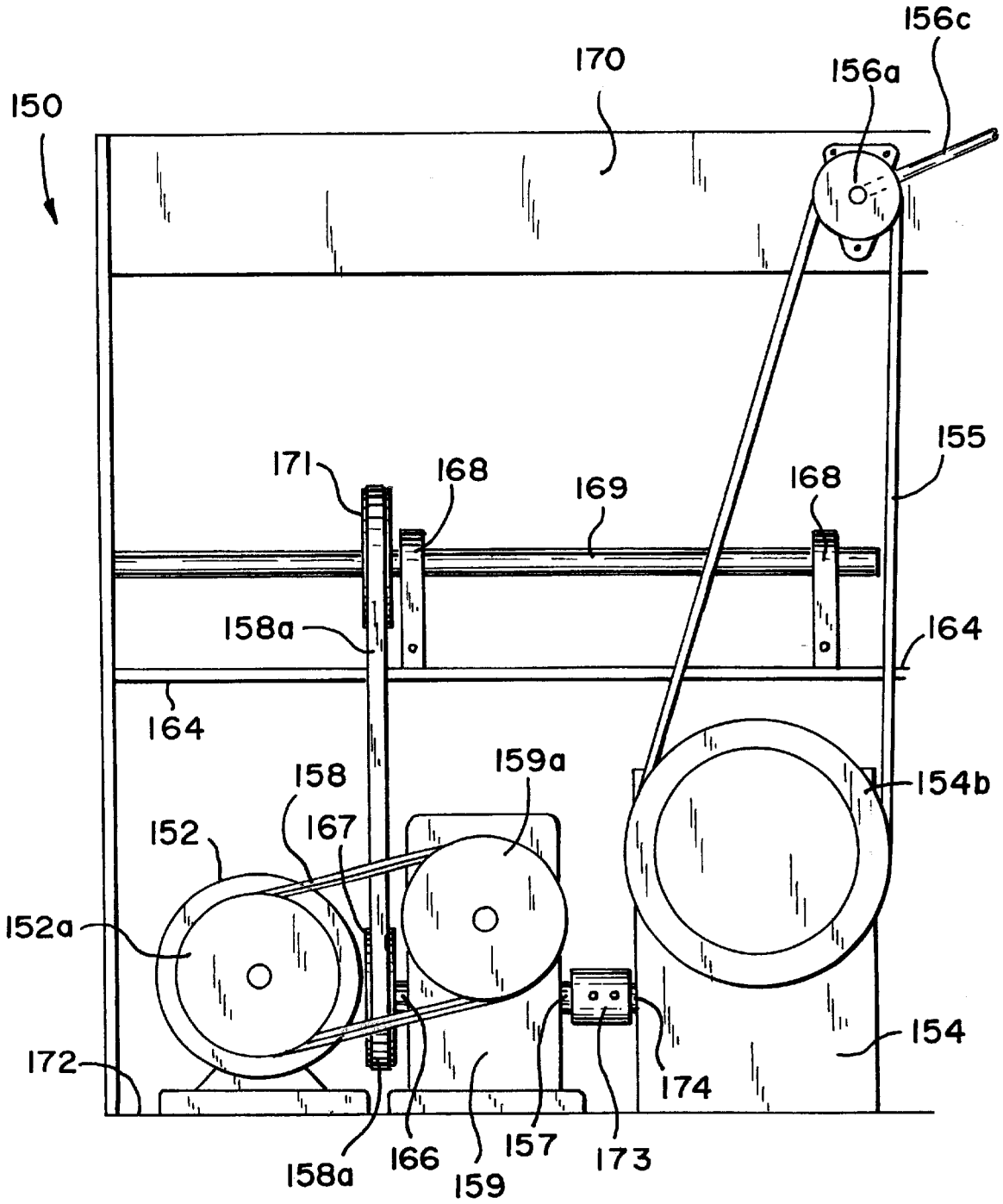
FIG. 15 is a rear view of the second embodiment of the main drive system of the mail inserter machine of FIG. 1.

As seen in FIG. 15, in second embodiment which utilizes a heavier and more powerful drive unit, the drive system 150 consists primarily of an electrically powered drive motor

152 having a motor pulley 152*a* and is mounted on a lower frame base 172, a drive gear reducer unit 159 having a receiving drive pulley 159*a*, and an indexing unit 154 having an indexing output clutched timing belt pulley 154*b*. The main drive system 150 also includes a cam shaft drive pulley 167. A timing chain 155 is in rotational connection with the belt pulley 154*b*. The gear reducer unit 159 is mounted to the lower frame base 172 adjacent the drive motor 152. A drive shaft 166 extends axially from the gear reducer unit 159. A cam shaft drive pulley 167 is mounted on the end portion of the drive shaft 166. A continuous drive cam shaft 169 is rotatably mounted on an elevated shelf 164 via bushing blocks 168. A cam shaft pulley 171 is mounted on the cam shaft 169 directly above the cam shaft drive pulley 167. A timing belt 158*a* is mounted on and between cam shaft pulley 171 and drive shaft pulley 167. The gear reducer unit 159 has two output drive shafts 166 and 157, wherein shaft 157 is directly connected by a coupling 173 to an input shaft 174 of the cam indexing unit 154. The cam indexing unit 154 via a timing chaim 155 drives the cross shaft timing pulley 156*a* which is positioned on the upper rear machine side rail 170. The shaft 156*c* extends horizontally across the inside of the machine, rear to front. In operation, the drive motor 152 powers the machine 10 by transferring power to the the drive pulley 159*a* via V drive belt 158, and thereby driving the output shaft 166 and 157.

As will be appreciated by one of ordinary skill upon review of FIG. 15, pulley 159*a* and pulley 154*b* rotate in planes parallel to one another, and pulley 156*a* rotates in a plane which is coplanar with pulley 154*b*.

Figure 17:
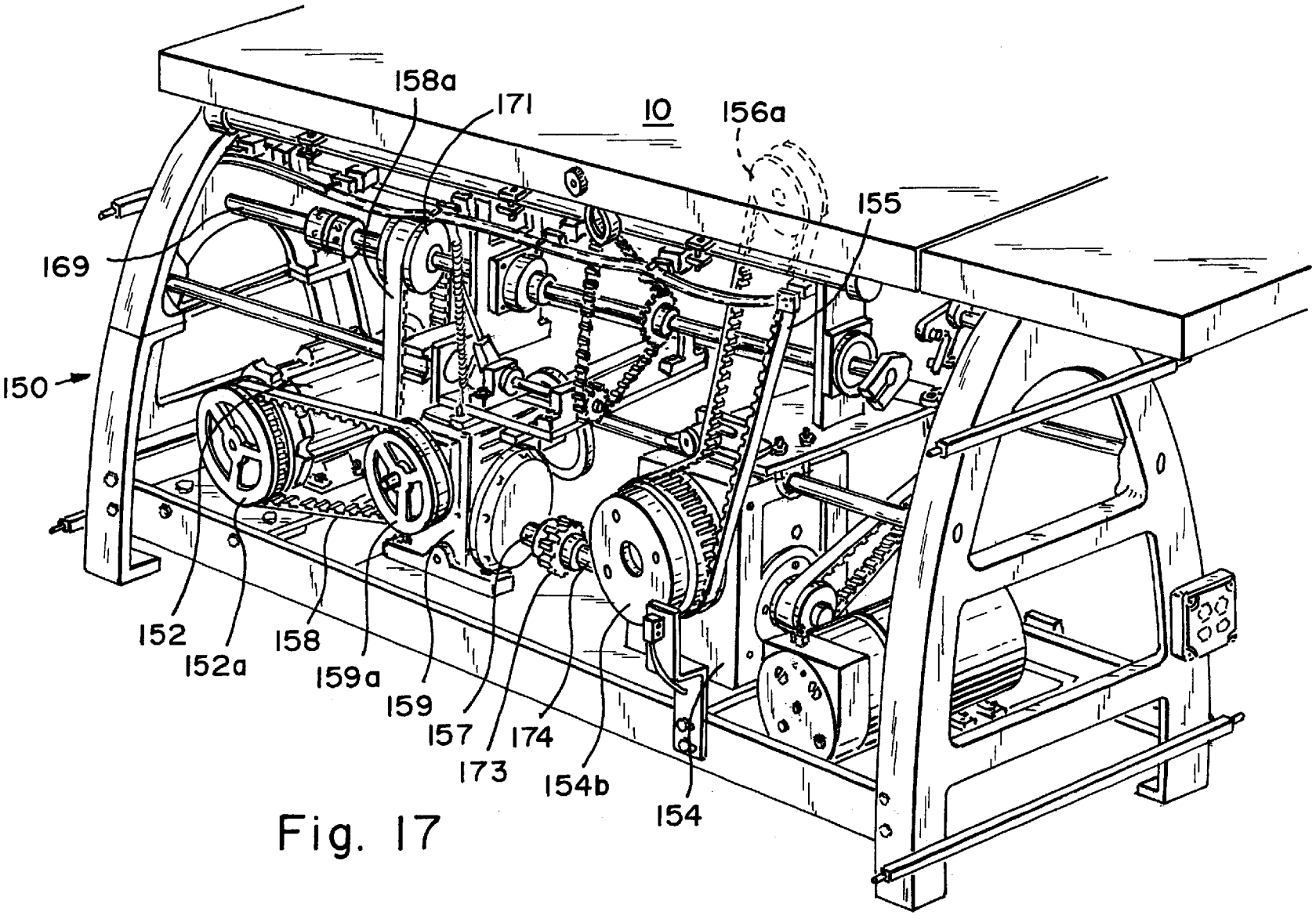
FIG. 17 is a perspective view of the mail inserter machine of FIG. 1 looking at the rear thereof as in FIG. 15 illustrating the second embodiment of the main drive system.
Figure 18:
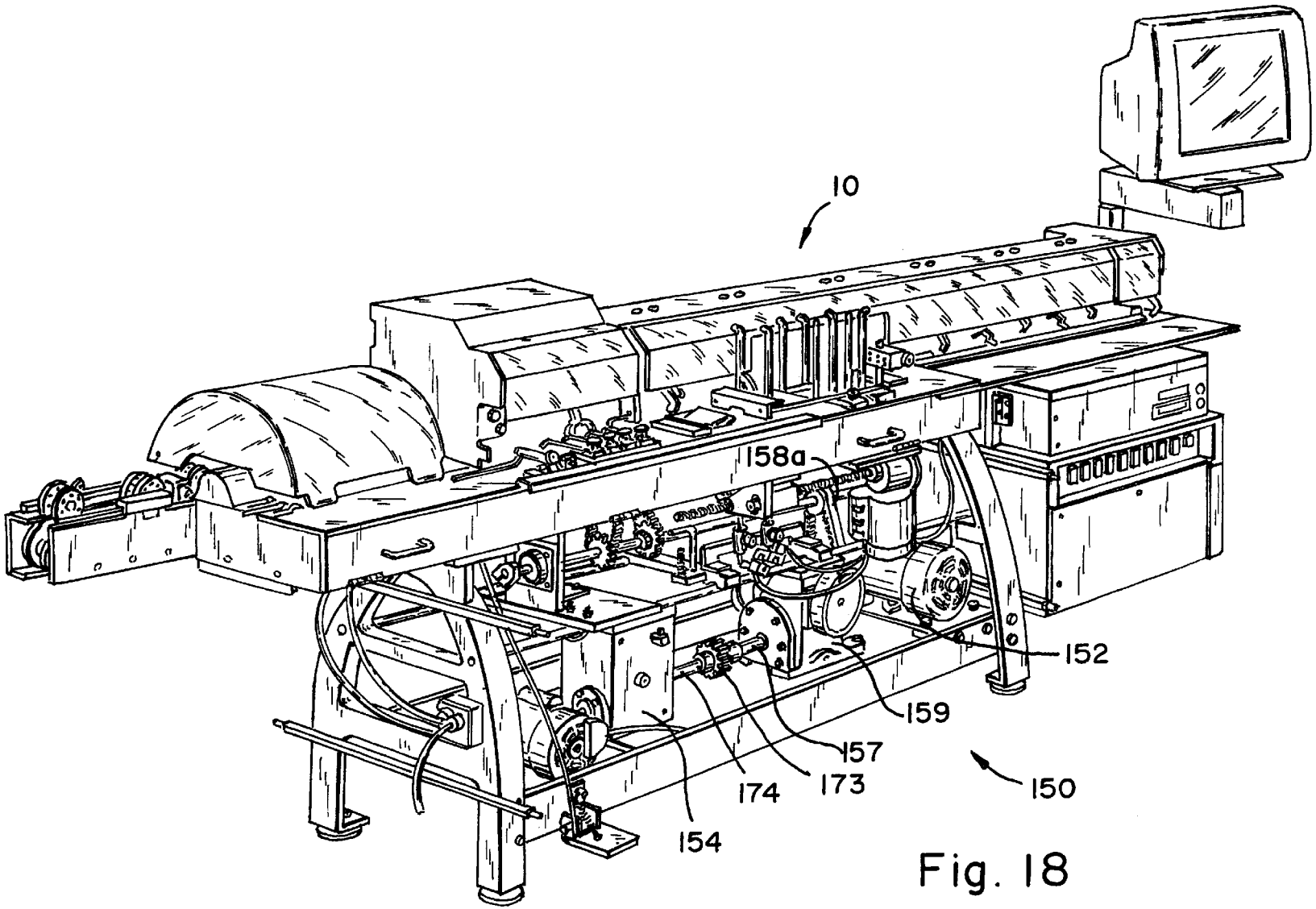
FIG. 18 is a perspective view of the mail inserter machine of FIG. 1, from a front view thereof and showing the second embodiment of the main drive system as in FIG. 15.

Further, as is apparent in FIGS. 1, 2, 5–6, 13–15, and as is known by one of ordinary skill, envelope inserter machines 10 have a principal axis along which rail 70, base 72, front table plate 24, shafts 14,30, lower mounting plate 60 and shelf 64 are aligned. The drawings show that pulleys 52*a*, 54*a*, 54*b* and 56*a* (in the first embodiment) and pulleys 152*a*, 159*a*, 154*b* and 156*a* (in the preferred embodiment of FIGS. 15, 17 and 18) all rotate in planes parallel to the principal axis. Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A mail inserter machine having a chassis, a cam shaft assembly, and a main drive system, said main drive system comprising:

a drive motor having a motor pulley;

a gear reducer unit having a receiving drive pulley and an output drive for directly driving an indexing unit driving an indexing timing pulley and a belt pulley, said receiving drive pulley timing pulley and belt pulley being in rotational connection and each rotating in planes parallel to said motor pulley; and said gear reducer unit having a drive shaft for driving a cam shaft drive pulley and a timing belt for driving a cam shaft of said cam shaft assembly, the cam shaft mounted to a cam shaft pulley, the cam shaft and output shaft being parallel to each other and parallel to said planes of said parallel planar pulleys;

whereby a substantially direct drive between said gear reducer unit and said indexing unit provides minimal loss of mechanical motion through the performance of timing and drive functions by a single direct drive in which the motor, receiving drive, indexing timing and belt pulleys are in parallel planes and the said cam shaft and output shaft of the gear reducer unit are parallel to themselves and to said pulley parallel planes, whereby the forces generated by the pulleys thereby are vectored in parallel directions, being parallel to said cam shaft and output shaft, and the drive system being located low in the inserter chassis enabling larger size, greater precision, higher durability, and greater dynamic stability on the inserter.

2. A mail inserter machine as in claim 1 wherein, a rotatable drive shaft extends from said drive, said drive shaft having a continuous drive pulley mounted thereto.

3. A mail inserter machine as in claim 2 wherein, said drive shaft includes an extendingend, said extending end being mounted in a bearing block.

4. The drive assembly of claim 1 further comprising:

said inserter machine having a principal axis with a vertical plane intersecting said axis;

each of said receiving drive pulley, an indexing timing pulley, belt pulley and motor pulley rotating in a plane perpendicular to said vertical plane.

5. A mail inserter machine having a chassis, a cam shaft assembly, and a drive system, the drive system comprising:

a motor for rotating a motor pulley;

a gear reducer unit for transmitting rotation having a receiving drive pulley and an output drive for directly driving an indexing unit driving an indexing timing pulley and a belt pulley, said drive pulley, timing pulley and belt pulley rotating in planes parallel to said motor pulley; and said gear reducer unit having a drive shaft for driving a cam shaft drive pulley and a timing belt for driving a cam shaft of said cam shaft assembly, the cam shaft mounted to a cam shaft pulley, the cam shaft and output shaft being parallel to each other and parallel to said planes of said parallel planar pulleys;

whereby a substantially direct drive among said motor pulley, said drive pulley, said belt pulley, and said indexing timing pulley provides minimal loss of mechanical motion, through the performance of timing and drive functions by a single direct drive between the gear reducer and indexing units, wherein said pulleys are in parallel planes and the forces generated thereby are vectored in parallel directions, and the drive system being located low in the inserter chassis enabling larger size, greater precision, higher durability, and greater dynamic stability on the inserter.

6. The drive assembly of claim 5 further comprising:

said indexing box means being integrally encased with a drive reducer means for reducing the relative rotational speed of said indexing timing pulley compared to said belt pulley.

7. The drive assembly of claim 5 further comprising:

said indexing box means being mechanically coupled to a drive reducer means for reducing the relative rotational speed of said indexing timing pulley compared to said belt pulley.

* * * * *